US005575022A

United States Patent [19]

Duffy et al.

[11] Patent Number: 5,575,022

[45] Date of Patent: Nov. 19, 1996

[54] SHOWER CUBICLE ENCLOSURE

[75] Inventors: Philip Duffy; Uwe Harms, both of Cape Town, South Africa

[73] Assignee: Sterling Plumbing Group, Inc., Rolling Meadows, Ill.

[21] Appl. No.: 367,021

[22] Filed: Dec. 30, 1994

[51] Int. Cl.[6] ..... A47K 3/22

[52] U.S. Cl. ..... 4/607; 4/557; 49/213

[58] Field of Search ..... 4/557, 558, 607, 4/608, 610; 49/40, 41, 213

[56] References Cited

U.S. PATENT DOCUMENTS

| | | | |
|---|---|---|---|
| 2,036,991 | 4/1936 | Tobin | 49/213 |
| 2,676,367 | 4/1954 | Trammel et al. | 49/213 |
| 3,216,716 | 11/1965 | Lunde et al. | 49/213 X |
| 3,225,393 | 12/1965 | Coller | 49/213 |
| 3,802,125 | 4/1974 | Baker . | |
| 3,995,563 | 12/1976 | Blunden . | |
| 4,807,312 | 2/1989 | Baus . | |
| 4,882,795 | 11/1989 | Baus . | |
| 4,903,433 | 2/1990 | Baus . | |
| 4,974,269 | 12/1990 | Baus . | |

FOREIGN PATENT DOCUMENTS

| | | | |
|---|---|---|---|
| 3600945 | 10/1986 | Germany | 4/607 |

*Primary Examiner*—Charles E. Phillips
*Attorney, Agent, or Firm*—Quarles & Brady

[57] ABSTRACT

A shower cubicle enclosure is disclosed. It has a fixed panel and a slidable panel for opening and closing an access opening, and a rail which defines a cylindrically curved track. The slidable panel has runner elements which cooperate with the track so as to guide the slidable panel for displacement between an open position in which the slidable panel is adjacent and spaced traversely from the fixed panel, and a closed position in which the panel closes the access opening. The fixed and slidable panels are both cylindrically curved. A parking element draws the trailing end of the slidable panel traversely towards the fixed panel as the slidable panel approaches the closed position, thus forming a water tight seal between the slidable and fixed panels.

4 Claims, 4 Drawing Sheets

SHOWER CUBICLE ENCLOSURE

FIELD OF THE INVENTION

This invention relates to a shower cubicle enclosure of the type having a slidable panel for opening or closing an access opening in an enclosure.

DESCRIPTION OF THE ART

Various shower door enclosures for corner alcoves are known. See e.g. U.S. Pat. Nos. 4,807,312, 4,882,795, and 4,903,433. However, such systems often use expensive components, do not provide a solid feel, make cleaning of the moveable doors and seal elements unduly difficult, and/or have unwanted projections. It would be advantageous to have a corner shower door assembly that is easy to clean, solidly supported along both upper and lower edges, relatively inexpensive to make and assemble, and safe in both open and closed positions.

SUMMARY OF THE INVENTION

According to the invention there is provided a shower cubicle enclosure which comprises a fixed panel; a slidable panel having a leading end and a trailing end, for opening or closing an access opening in the enclosure; and a rail which defines a curved track. The slidable panel has runner elements which cooperate with the track so as to guide the slidable panel for displacement between an open position in which the slidable panel is retracted behind and spaced transversely from the fixed panel, and a closed position in which the leading end of the slidable panel extends from the fixed panel to close the access opening. The fixed panel and the slidable panel are each of cylindrically curved configuration.

Means are provided for drawing the trailing end of the slidable panel transversely towards the fixed panel as the slidable panel approaches the closed position. The means may comprise a crank or parking formation in the track.

The slidable panel has a leading runner element and a trailing runner element, and the trailing runner element cooperates with the crank formation as the slidable panel approaches the closed position.

The rail may comprise an extrusion, part of the longitudinal extent of which extrusion has been removed and replaced by an insert so that the track is formed for part of its longitudinal extent by the extrusion and part by the insert, the crank formation being in that part of the track which is formed by the insert.

The extrusion may, for example, be of aluminum, and the insert of a plastics material.

The enclosure may comprise a pair of said fixed panels and a pair of said slidable panels, the fixed panels being on opposite sides of the access opening, and the slidable panels being displaceable from opposing sides of the access opening towards one another to close the access opening.

The crank formation may be a double crank formation, for drawing the trailing end of the slidable panel transversely towards the fixed panel as the slidable panel approaches the closed position, and for again displacing the trailing end of the slidable panel transversely away from the fixed panel as the slidable panel is displaced further, beyond the closed position.

Therefore, the objects of the invention include providing a partition for a corner alcove of the above kind:

a. which is simple and cost-effective;

b. which is safe in both stored and closed positions;

c. wherein all components of the moving doors are easily accessible; and d. which includes moveable doors that are fully supported along both their upper and lower edges.

These and other objects and advantages of the invention will become apparent from the description which follows. In the description, the preferred embodiments will be described with reference to accompanying drawings. These embodiments do not represent the full scope of the invention. Rather, reference should be made to the claims herein for interpreting the full scope of the invention.

DETAILED DESCRIPTION OF THE PREFERRED EMBODIMENT

Figure 1:
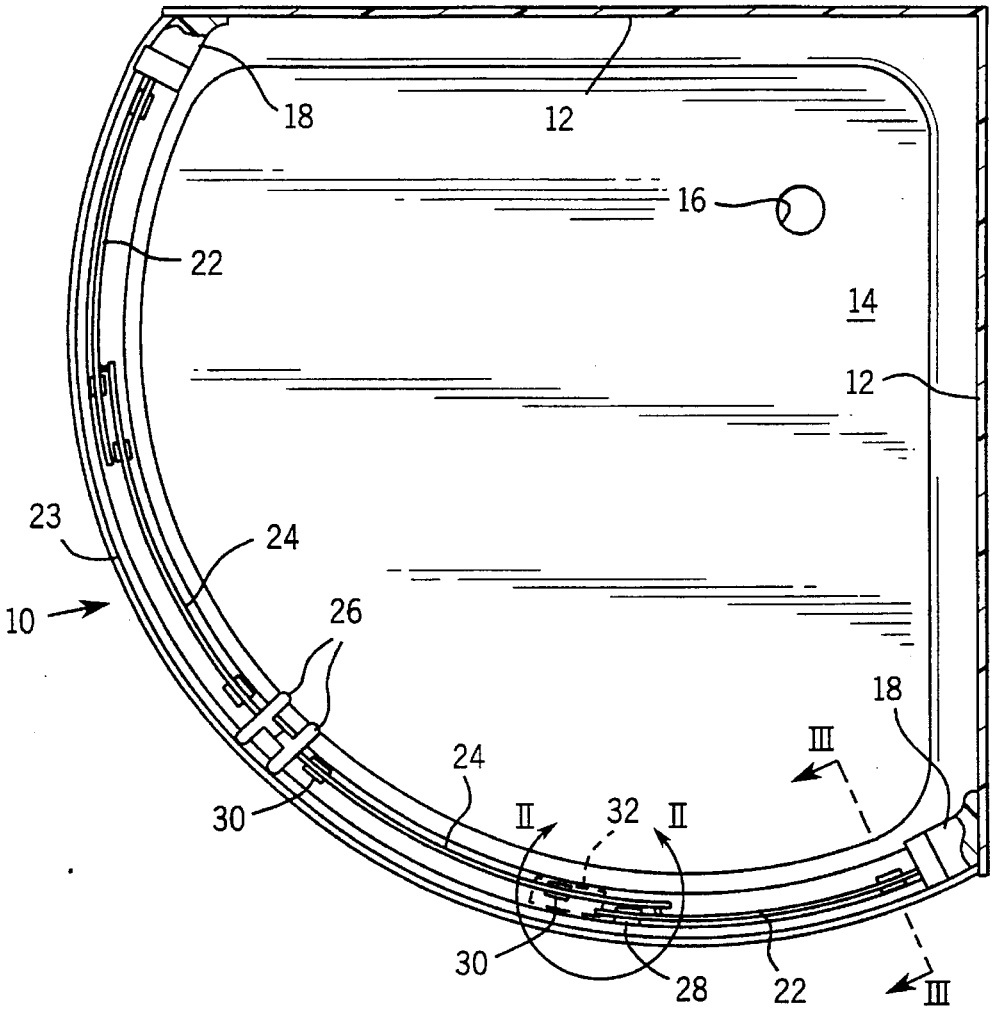
FIG. 1 is a cross sectional view taken along the line I—I of FIG. 10.
Figure 10:
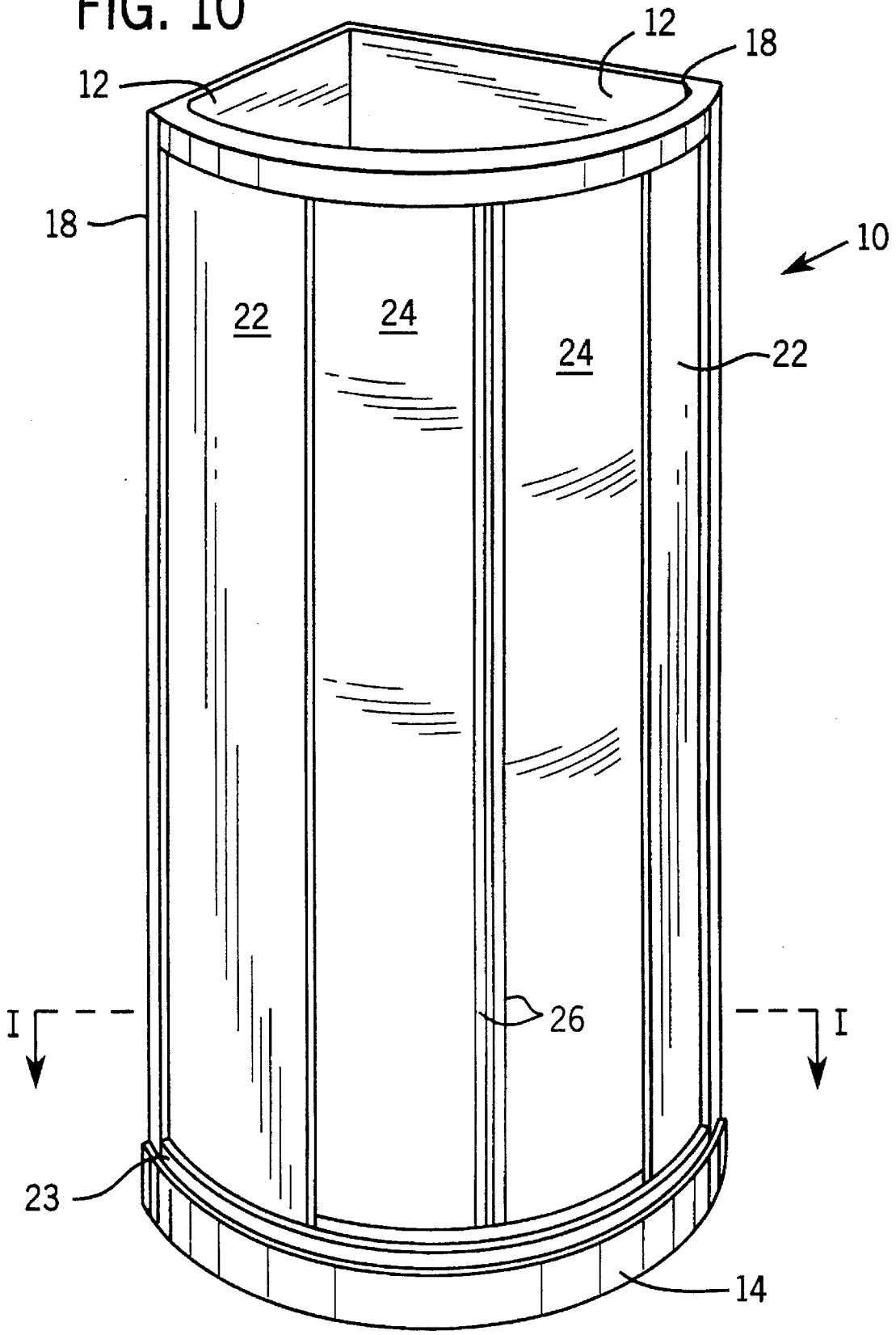
FIG. 10 is a perspective view of a shower cubicle according to the present invention.

Referring now to FIGS. 1 and 10, reference numeral 10 generally indicates a shower cubicle enclosure which is installed in the corner of a bathroom, where two walls 12 of the bathroom meet. The floor of the cubicle is formed in the conventional manner by a glass fibre-reinforced plastics tray 14, there being a drain opening 16 in the tray.

The partition 10 comprises a framework structure of extruded aluminum profiles, there being a pair of uprights 18 each secured to a corresponding one of the walls 12, and continuously curved upper and lower rails 21 and 23 respectively. The partition 10 further has a pair of fixed, cylindrically curved panels 22, and a pair of slidable, cylindrically curved panels 24. Each of the slidable panels 24 has a hand grip 26. As will be described in more detail hereinafter, the slidable panels 24 have runner elements which cooperate with tracks so that they can slide behind the fixed panels 22, to open or close an access opening through which a person can enter or leave the cubicle.

Figure 3:
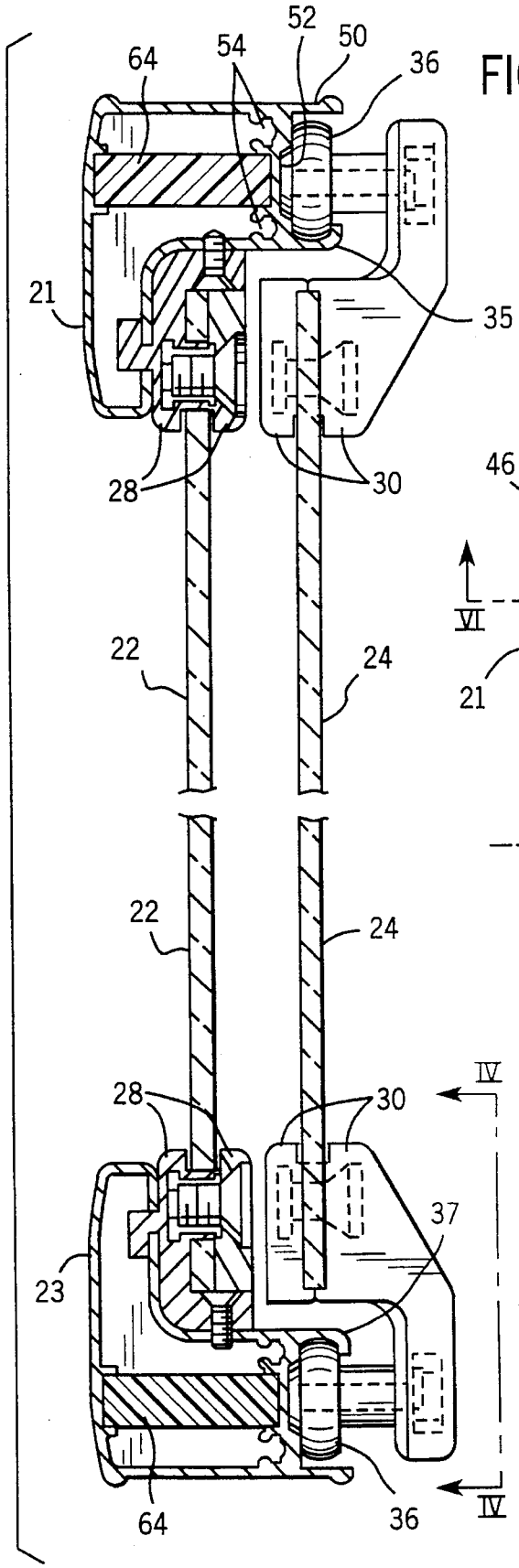
FIG. 3 is a cross-sectional view taken along the line III—III of FIG. 1.

The panels 22 and 24 are of toughened glass, although it is to be understood that they can also be of acrylic or other suitable material. Referring also to FIG. 3, in the case of the fixed panels 22, they are fixed to the upper and lower rails 21 and 23 by means of patch fittings 28. Where the fixed panel 22 joins the corresponding upright 18, a sealing strip is provided to form a water-tight seal. In the case of the slidable panels 24, they are fixed to runner elements, as will be described in more detail hereinafter, by means of patch fittings 30. Each of the slidable panels 24 has two runner elements at the top and two runner elements at the bottom.

The particular construction of the patch fittings 28 and 30 is not of importance to the present invention and will therefore not be described in detail, but it is to be noted that, of necessity, they protrude on opposite sides of the panels 22 and 24. There should therefore be a certain minimum transverse spacing between the panels 22 and 24, when the slidable panels 24 slide behind the fixed panels 22 (otherwise the patch fittings 28 and 30 will bump against one another and as a result interfere with the free movement of the panels 24).

This transverse spacing would be a problem when the slidable panels 24 are in their closed condition, since it would leave gaps through which water can splash out of the cubicle. This problem is dealt with in accordance with the present invention by providing the upper and lower rails 21 and 23 each with a parking bay element or guide extension 32, in the region of that vertical edge of each of the fixed panels 22 which is opposite the corresponding upright 18.

Figure 4:
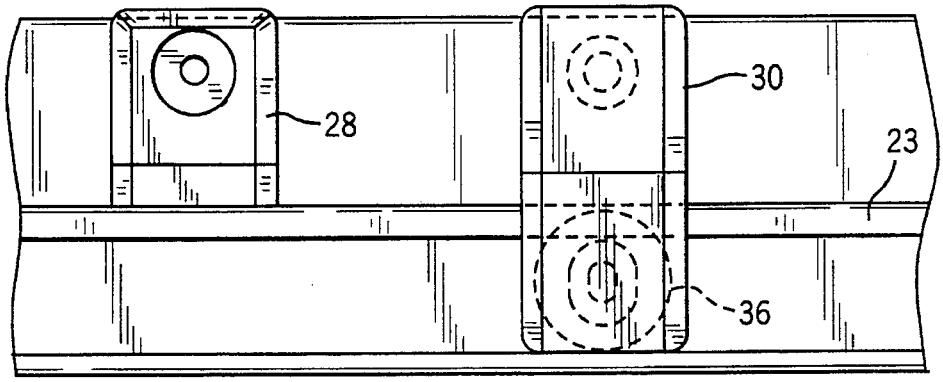
FIG. 4 is a view in the direction of IV in FIG. 3.

Referring still to FIG. 3, the profile of the upper rail 21 forms an upwardly facing track 35, and the profile of the lower rail 23 forms a downwardly facing track 37. Referring also to FIG. 4, the runner elements referred to earlier are in the form of rollers 36 which, as mentioned earlier, are attached to the slidable panels 24 by means of the patch fittings 30. The rollers 36 run in the tracks 35 and 37.

Figure 5:
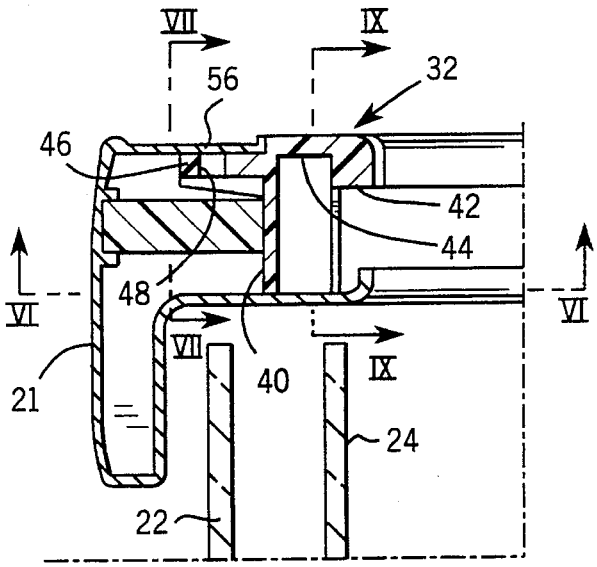
FIG. 5 is a cross-sectional view taken along the line V—V of FIG. 2.
Figure 6:
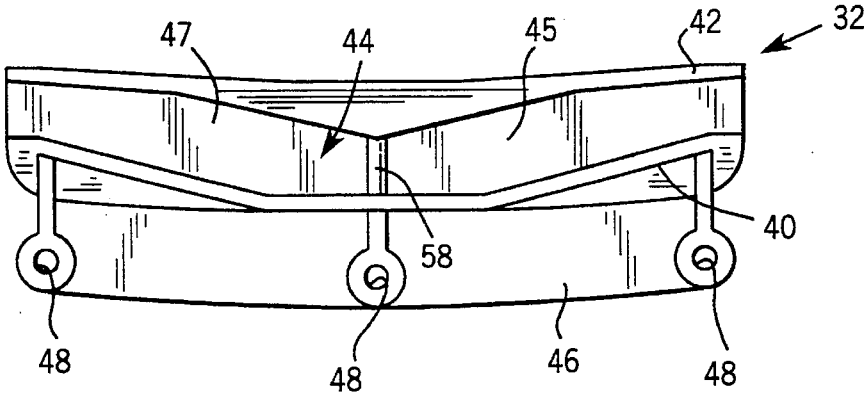
FIG. 6 is a bottom view (in the direction of VI in FIG. 5) of a parking bay element.

Referring to FIGS. 5 and 6, each parking bay element 32 is in the form of a molded plastic component which has a deep rear wall 40 and a shallow front wall 42, the walls defining between them a channel 44 along which the corresponding roller 36 can run. The channel has a first cranked portion or path extension 45 and a second cranked portion or path extension 47.

Figure 7:
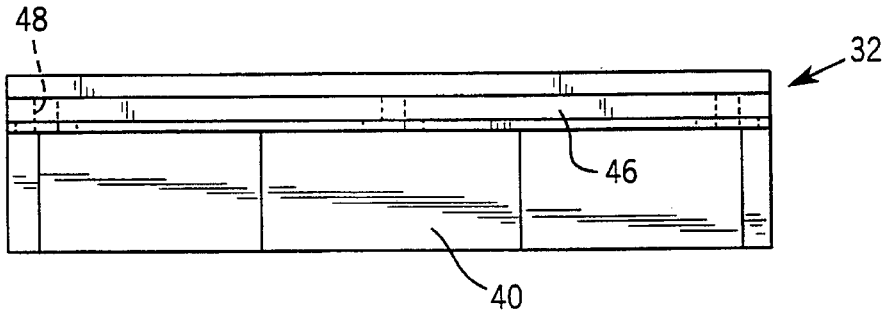
FIG. 7 is a rear elevational view (in the direction of VII in FIG. 5) of the parking bay element.
Figure 8:
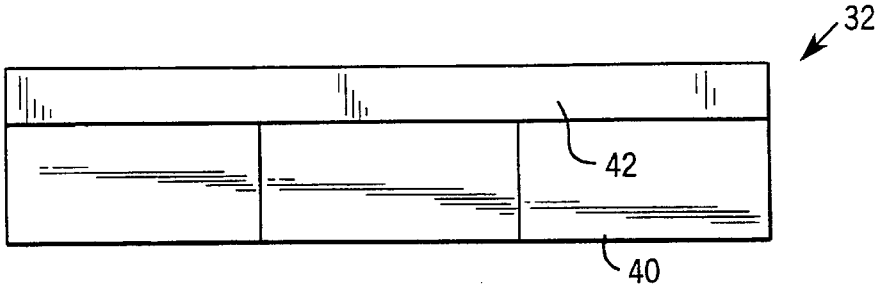
FIG. 8 is a front elevational view of the parking bay element.

Referring also to FIGS. 7 and 8, the parking bay element 32 further has a fixing flange 46 with screw openings 48 therein, for use in fixing the parking bay element to the upper or lower rail 21 or 23 as the case may be. To fix the parking bay element 32 in position, parts of the aluminum profile are routed away so that the parking bay element can fit in the position as illustrated in FIG. 5. The parts that are routed away include a lip 50, vertical web 52, and parts 54 that form screw ports. The parking bay element 32 is then fastened in position by means of screws 56 that pass through holes drilled for this purpose in the aluminum extrusion, and enter into the screw openings 48.

Figure 9:
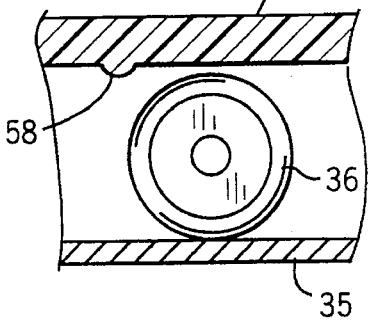
FIG. 9 is a cross-sectional view taken along the line IX—IX in FIG. 5.

As can best be seen in FIGS. 6 and 9, the parking bay element 32 has a ridge 58 that extends across the width of the channel 44. The distance between the crest of the ridge 58 and the sill 35, 37 is slightly smaller than the diameter of the roller 36. Thus, while the resiliency of the materials that are used will permit the roller 36 to pass beyond the ridge 58, the ridge does offer a certain degree of resistance to this happening.

The trailing edge of each of the slidable panels 24 is fitted with an extrusion 60 which has a flexible sealing strip 62 affixed thereto. Reference numeral 64 in FIG. 3 indicates a plastic strip which is inserted into the profiles 21 and 23 for bending purposes.

When the slidable panels 24 are in their open position, i.e., in the position in which they are retracted behind the fixed panels 22, they are spaced sufficiently far behind the fixed panels so that the patch fittings 30 will clear the patch fittings 28 (see FIG. 3) when the slidable panels 24 are moved towards the closed condition.

Figure 2:
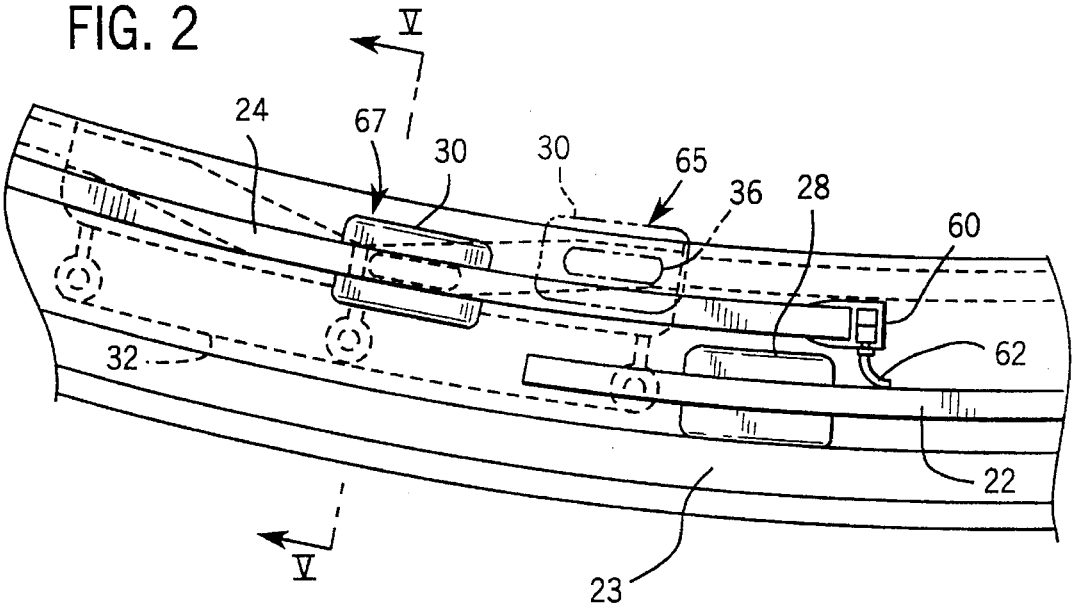
FIG. 2 is a detailed view of that part of the partition indicated at II in FIG. 1.

FIG. 2 shows the trailing runner in two positions. Reference numeral 65 shows the trailing runner in the position it is in just before the slidable panel 24 has reached the fully closed condition, and reference numeral 67 shows the trailing runner in the position it is in when the slidable panel 24 is in the fully closed condition. As the runner moves from the position 65 to the position 67, the roller 36 runs along the first cranked portion 45 of the channel 44. As this happens, the trailing end of the slidable panel 24 is displaced transversely towards the fixed panel 22, bringing the sealing strip 62 into contact with the fixed panel 22. The slidable panel 24 has reached the fully closed position when the roller 36 abuts on the ridge 58.

If desired, for cleaning purposes, the slidable panel 24 may be moved beyond the fully closed position (with the opposite slidable panel 24 moving back to the open position). This will cause the roller 36 at the trailing end of the slidable panel or path extension in question to move along the second cranked portion 47 of the parking bay element, moving the slidable panel 24 transversely away from the fixed panel 22 again. The trailing end of the slidable panel 24 will now be clear of the fixed panel 22, facilitating cleaning.

Although a preferred embodiment of the invention has been described above, the invention claimed is not so restricted. For example, while the invention is described as having first and second crank portions, the invention can clearly be practiced with only the first crank portion. In addition, for cleaning purposes, only the second crank portion and not the first crank portion could be included in any of the prior art discussed above if desired. Thus, the invention is not limited by the specific description above. Rather it should be judged by the claims which follow.

We claim:

1. A shower enclosure which comprises:

a fixed panel;

a slidable panel having a leading end and a trailing end, for opening or closing an access opening in the enclosure; and a rail which defines a curved track;

wherein the slidable panel has runner elements which cooperate with the track so as to guide the slidable panel for movement between an open position in which the slidable panel is retracted behind and spaced transversely from the fixed panel, and a closed position in which the leading end of the slidable panel extends from the fixed panel to close the access opening;

wherein the fixed panel and the slidable panel each are of cylindrically curved configuration;

wherein means are provided for drawing the trailing end of the slidable panel transversely towards the fixed panel as the slidable panel approaches the closed position said means comprises a parking formation in the track, the slidable panel has a leading runner element and a trailing runner element, and the trailing runner element cooperates with the parking formation as the slidable panel approaches the closed position; and wherein the parking formation includes two converging track portions which move the trailing end of the slidable panel transversely towards the fixed panel as the slidable panel approaches the closed position, and displace the trailing end of the slidable panel transversely away from the fixed panel as the slidable panel is displaced further, beyond the closed position.

2. The enclosure of claim 1, wherein the enclosure comprises a pair of said fixed panels and a pair of said slidable panels, the fixed panels being on opposite sides of the access opening, and the slidable panels being displaceable from opposite sides of the access opening towards one another to close the access opening.

3. The enclosure of claim 1, wherein the rail comprises an extrusion, part of the longitudinal extent of which extrusion has been removed and replaced by an insert so that the track is formed for part of its longitudinal extent by the extrusion and part by the insert, the parking formation being in that part of the track which is formed by the insert.

4. The enclosure of claim 3, wherein the extrusion is of metal and the insert of a plastic material.

* * * * *